US005123146A

United States Patent [19]

Olson

[11] Patent Number: 5,123,146

[45] Date of Patent: Jun. 23, 1992

[54] BAG CLOSURE

[75] Inventor: Earle L. Olson, Medina, Ohio

[73] Assignee: Olson Products, Inc., Medina, Ohio

[21] Appl. No.: 85,624

[22] Filed: Aug. 14, 1987

[51] Int. Cl.[5] ..... B65D 77/10

[52] U.S. Cl. ..... 24/30.5 R; 24/30.5 P; 24/487

[58] Field of Search ..... 24/30.5 R, 30.5 P, 30.5 S, 24/16 PB, 461, 487, 535, 542, 543, 545, 557, 563, 565, 568

[56] References Cited

U.S. PATENT DOCUMENTS

| | | | |
|---|---|---|---|
| D. 218,515 | 8/1970 | Tomaiudo | 24/30.5 R X |
| D. 276,596 | 12/1984 | Kisha | 24/305 P X |
| T. 983,001 | 6/1979 | Coffey | 24/30.5 R X |
| 1,959,318 | 5/1934 | Sundback | 24/205 |
| 2,144,755 | 1/1939 | Freedman | 24/201 |
| 2,353,858 | 7/1944 | Tedesco | 24/206 |
| 2,519,290 | 8/1950 | Saltz | 150/3 |
| 2,520,467 | 8/1950 | Merralls | 150/3 |
| 2,709,290 | 5/1955 | Rosenthal | 24/204 |
| 2,789,609 | 4/1957 | Post | 150/3 |
| 2,997,765 | 8/1961 | Markoff-Moghadam | 24/201 |
| 3,112,542 | 12/1963 | Brunson | 24/30.5 R |
| 3,246,376 | 4/1966 | Vazquez | 24/160 |
| 3,338,285 | 8/1967 | Jaster | 150/3 |
| 3,363,293 | 1/1968 | Nemrod | 24/30.5 |
| 3,461,876 | 8/1969 | Miller, Jr. | 128/346 |
| 3,571,861 | 3/1971 | Olson | 24/30.5 |
| 4,466,160 | 8/1984 | de Lima Castro Netto | 24/30.5 R |
| 4,534,089 | 8/1985 | Swan | 24/30.5 P X |

FOREIGN PATENT DOCUMENTS

| | | | |
|---|---|---|---|
| 270934 | 5/1964 | Australia . | |
| 156779 | 10/1985 | European Pat. Off. | 24/30.5 R |
| 1412518 | 8/1965 | France . | |
| 614520 | 12/1960 | Italy . | |
| 638338 | 4/1962 | Italy . | |

*Primary Examiner*—Laurie K. Cranmer
*Attorney, Agent, or Firm*—Reese Taylor

[57] ABSTRACT

A one-piece molded resilient closure includes opposed legs joined by a hinge so that the legs may be folded over on themselves. One leg carries a male locking member and the other a socket for releasable engagement therewith. One or both legs terminate in outer finger-engaging ends and the leg having the socket also has a pressure pad for engagement with a thumb or finger to facilitate flexing of its outer end to engage or disengage the socket with the male locking member.

1 Claim, 2 Drawing Sheets

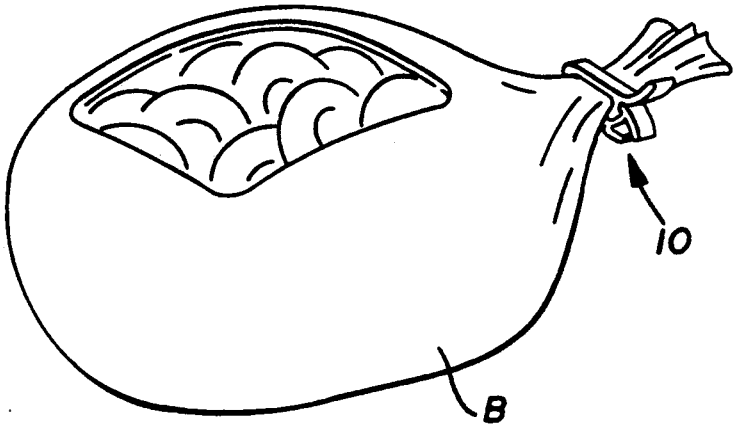
FIG. 7
FIG. 6
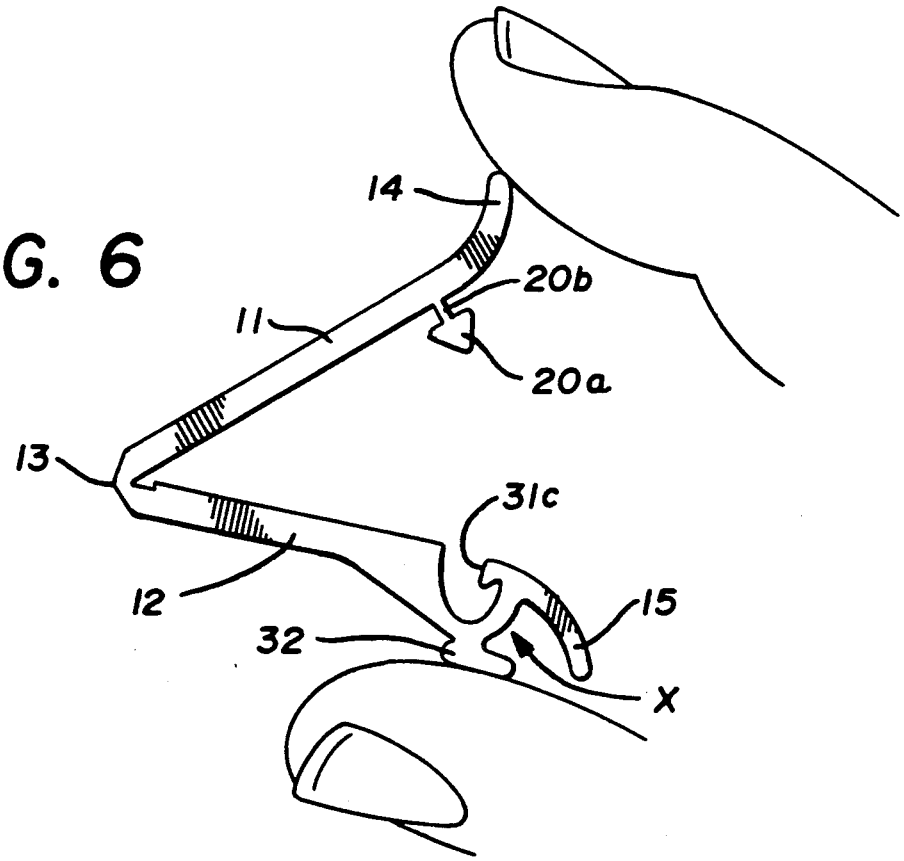

BAG CLOSURE

BACKGROUND OF THE INVENTION

This invention relates, in general, to closures for bags and other flexible receptacles and relates, in particular, to a resilient plastic clip capable of providing a substantially airtight clamp closure and operable with one hand.

DESCRIPTION OF THE PRIOR ART

The sealing of flexible plastic bags or other flexible receptacles, commonly used for food or other perishable products, as well as for other diverse uses, has conventionally been accomplished by using a thin plastic or papercovered wire strip which is wrapped around the neck of the bag and twisted to close the same. These tie devices frequently do not provide an airtight seal which, particularly in food related usage, is critical.

It is also necessary to twist these strips a number of times to make sure that they are securely interconnected. This is time-consuming and also the plastic or paper coverings tend to disintegrate in use, leaving the bare wire which is uncomfortable to use.

Some attempts have been made to replace these tie-type closure devices by utilizing a snap-type clip for sealing these bags. Such clip devices generally are complex and include a plurality of interfitting connecting shoulders and recesses, etc., and are, therefore, somewhat expensive to produce and not entirely satisfactory for their intended purposes. Examples of clips of this general nature can been seen in Rosenthal U.S. Pat. No. 2,709,290; Miller U.S. Pat. No. 3,461,876; Vazquez U.S. Pat. No. 3,246,376; Nemrod U.S. Pat. No. 3,363,293; Australian Patent Specification 270,934; Italian Patent 614,520; Italian Patent 638,338 and French Patent 1,412,518.

Additionally, closure devices for receptacles of this general nature of the zipper-type are relatively well-known in the art. Examples can be seen in Sundback U.S. Pat. No. 1,959,318; Freedman U.S. Pat. No. 2,144,755; Saltz U.S. Pat. No. 2,519,290; Merralls U.S. Pat. No. 2,520,467; Tedesco U.S. Pat. No. 2,353,858; Post U.S. Pat. No. 2,789,609; Jaster U.S. Pat. No. 3,338,285; and Markoff-Moghadam U.S. Pat. No. 2,997,765. These, however, are closures of the type which are generally integral with the bag or other receptacle being closed and, therefore, are of limited utility in that they can only be used with the bag of which they are a part.

Perhaps the best solution to the problem known to the prior art can be seen in Olson U.S. Pat. No. 3,571,861 wherein a one-piece molded resilient plastic clip for sealing bags of this type is disclosed and which is generally capable of one-hand operation.

Olson discloses a one-piece molded plastic clip having a first elongated leg hingedly attached to a second elongate leg with the ends of the legs bearing complemental snaps. The legs have integral finger-positioning means formed thereon to facilitate manual opening and closing.

SUMMARY OF THE INVENTION

The present invention comprises an improved one-piece, molded, resilient plastic clip, similar to that shown in the Olson patent, and formed with a pair of hingedly-connected legs which can be clamped over the neck of a bag or the like and snapped into place to provide a seal.

The present invention, however, provides an improvement over the applicant's earlier patent in that it provides structure which greatly facilitates opening and closing of the closure member.

It is, therefore, an object of the present invention to provide a closure clip which is well-suited for sealing bags of this general nature and which can be utilized for other purposes, such as holding two separate articles together or even for uses as remote as clamps for surgical use.

It has been found that in achieving these objects, it is advantageous to provide a one-piece resilient clip having opposed male and female locking members and suitable finger-engaging surfaces so that the clip can be readily and easily clipped onto the bag with one hand and can equally well be removed from the bag with one hand.

It has thus been found that a pressure pad can be provided on the one leg beneath the complemental snaps so as to enable the thumb or finger of the user to engage the pad and flex the one leg so as to facilitate engagement of the locking members. This arrangement also makes it possible to exert snapping force directly on the locking members during closure.

It has also been found that this structure also provides a firm seat for the thumb or finger of the user so as to enable the end of the one leg to be pinched and thus flexed to facilitate disengagement of the locking members during opening.

Accordingly, then, production of an improved bag closure of the character above-described becomes the principal object of this invention with other objects thereof becoming more apparent upon a reading of the following brief specification considered and interpreted in view of the accompanying drawings.

OF THE DRAWINGS

FIG. 6 is a view similar to FIG. 3 showing an alternative closing technique.

FIG. 7 is a perspective view showing a typical bag with the novel closure installed thereon.

BRIEF DESCRIPTION OF THE PREFERRED EMBODIMENTS

Figure 1:
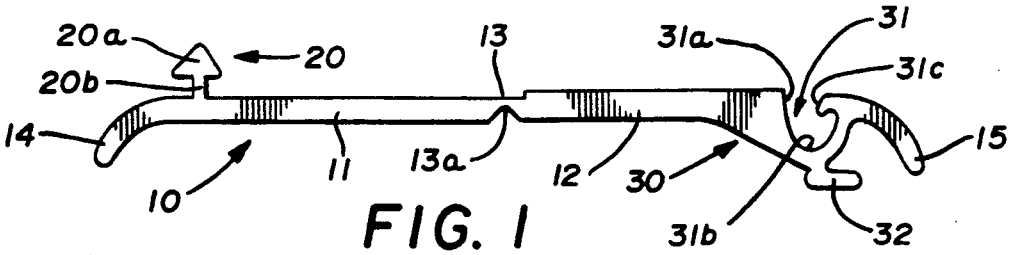
FIG. 1 is a side elevational view of the bag closure in an open position.
Figure 2:
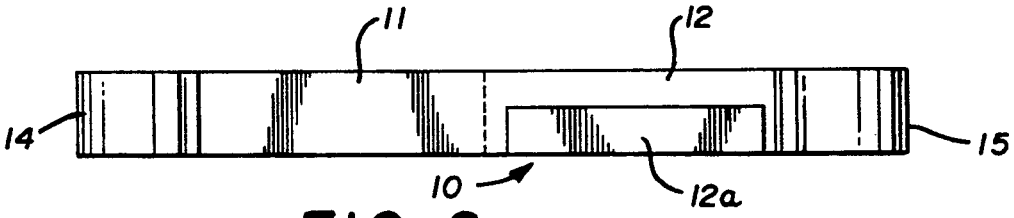
FIG. 2 is a top plan view of the closure in the open position.

Referring, first, to FIGS. 1 and 2 of the drawings, it will be seen that the improved closure, generally designated by the numeral 10, comprises a first elongate leg 11 and a second elongate leg 12 connected thereto by a hinge section 13. It will be understood that the closure 10 is generally molded of a resilient material, such as plastic, for example, and that the legs 11 and 12 and the hinge section 13 are thus integral.

Figure 4:
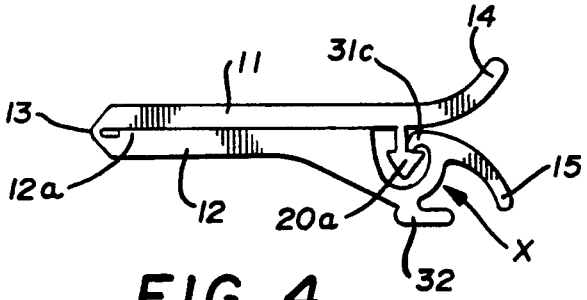
FIG. 4 is a side elevational view showing the closure in the closed position.

Still referring to FIGS. 1 and 2 of the drawings, it will be noted that the hinge 13 preferably includes a notched or cut out portion 13*a* which facilitates folding the legs 11 and 12 to an overlying closed position, as illustrated, for example, in FIG. 4 of the drawings. This permits the surfaces of the legs 11 and 12 to be disposed, at least theoretically, in flush engagement with each other to thereby facilitate the interfitting of the locking means which will be described below. Of course, when the closure 10 is used as shown in FIG. 7, the bag material will be trapped between the facing surfaces of the legs.

Referring, again, to FIGS. 1 and 2 of the drawings, it will be noted that the first leg 11 is provided with an outer end portion 14 which is, of course, also integral with the overall closure 10 and is formed in the molding process. This end is illustrated as curving outwardly away from the plane of the leg to provide a finger engaging portion, although it could take other forms.

The second leg 12 has a somewhat similar outer end portion 15 which, again, is integral with the overall closure 10 and is again illustrated as optionally curving away from the plane of the leg.

These end portions 14 and 15 are designed so that they can be engaged by the thumb and finger of the user in order to close or open the clip 10, as will be described in greater detail below.

Referring, still, to FIGS. 1 and 2 of the drawings, it will be noted that the first leg 11 also has a male locking member 20 which is integral with the leg 11 and projects from one surface thereof in an opposite direction to that of the projection of the curved end 14. This locking member 20 has a wedge-shaped projection 20*a* and is connected to first leg 11 by the support leg 20*b*. As suggested above, the finger engaging portion 14 could be eliminated and the first leg could terminate adjacent locking member 20.

The second leg 12 includes an enlarged area, generally indicated by the numeral 30, which is disposed inboard of the outer end 15 between the hinge section 13 and the main portion of the leg 12. This enlarged portion 30 includes an opening 31 which extends into the enlarged portion from the one surface of the second leg 12 and serves as a female locking member. The opening 31 is formed by a straight wall 31*a* which extends inwardly from the face of leg 12 and is tangential with an inner radiused area 31*b*. Opposite wall 31*a* is an overhanging lip 31*c* which tends to restrict the opening and which is engagable with locking member 20 as will be described.

Additionally, it will be noted from FIG. 4 that the face of lip 31*c* of this narrow opening is tapered complemental to the taper on the wedge-shaped member 20. This facilitates entrance of the wedge-shaped member into the opening 31, keeping in mind, of course, that the overall clip is made of resilient material so that the wedge-shaped member 20 can be forced through the opening. Once inside, however, the overhanging lip 31*c* projects sufficiently into the opening so as to prevent inadvertent removal or dislodgment of the wedge-shaped member 20.

On the outer surface of the enlarged portion 30 is a finger-engaging pressure member or pad 32 which is integral therewith and generally lies in a plane parallel to that of the leg 12, whether in the opened or closed position and generally beneath opening 31.

Figure 3:
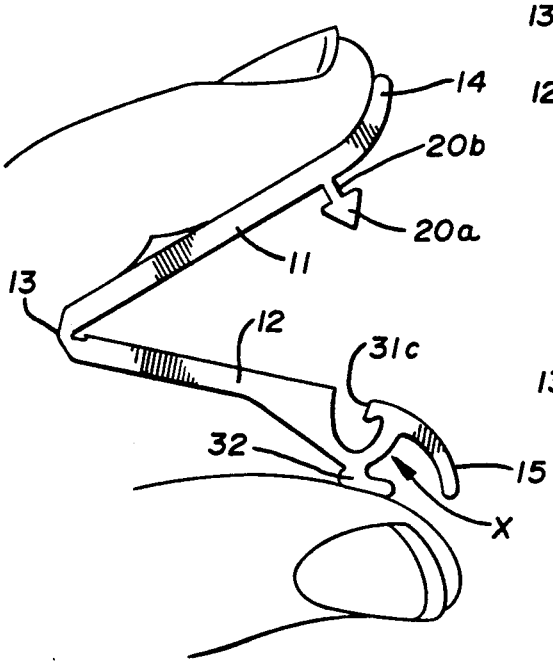
FIG. 3 is a side elevational view showing the closure in the process of being closed.

In use or operation of the improved clip, reference will be had to FIGS. 3 and 6 of the drawings wherein it will be noted that the thumb and finger of the user will be applied to the clip to close it. These figures illustrate alternative techniques for closing the clip. Specifically, in FIG. 3 the finger can be placed in engagement with the outer surface of the end 14 and the thumb can be placed in engagement with the pressure member 32 of the enlarged area 30. FIG. 3 clearly illustrates this positioning. It will be noted that the FIG. 3 disposition is probably most likely although the thumb and finger positions could obviously be reversed, as shown in FIG. 6, if desired, without affecting operation of the closure.

The legs 11 and 12, of course, will flex about the hinge 13 to facilitate movement from the position of FIG. 1 to the position of FIG. 3 or FIG. 6 and, ultimately, to the position of FIG. 4. It will be noted, as previously mentioned, that the clip is of flexible resilient material and that the wedge-shaped locking member 20 can penetrate the opening 31 with its entry being facilitated by the inclined surface of lip 31*c*, adjacent one side of the opening, so as to snap into place in opening 31. It will also be noted that the neck 31*c* will overhang the flat portion of the male locking member 20 so as to prevent inadvertent removal.

It will also be noted that during the closing operation, pressure from the user's thumb will be directed pressure pad 32 so as to flex the outer end 15 about point X and spring the lip 31*c* sufficiently away from wall 31*a* to permit easy entry of locking member 20. Release of closing pressure permits the neck 31*c* to spring back and engage member 20 as shown in FIG. 4.

It will also be noted that the leg 12 has a raised area 12*a* so that when the device is closed, the tendency of legs 11 and 12 to bow is compensated for. As can be seen in FIG. 4 of the drawings, this arrangement makes it possible, when the device is closed, for the surface of the leg 11 and raised area 12*a* to be placed in flush engagement for improved sealing. Obviously, of course, if material, such as the plastic of the bag, is between these two legs, they will not be in absolutely flush engagement, but this structure makes it possible to provide a substantially airtight seal.

Figure 4A:
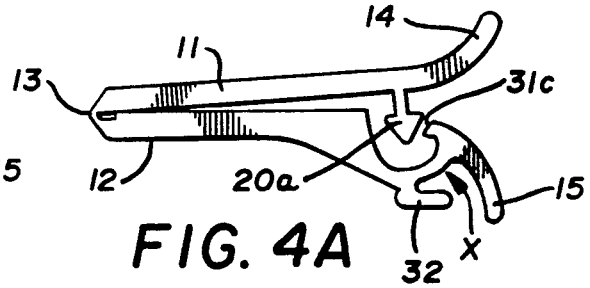
FIG. 4A is a side elevational view showing the closure partially opened.
Figure 5:
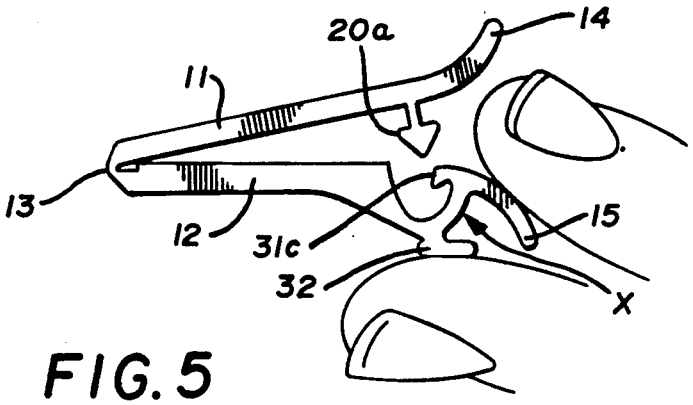
FIG. 5 is a side elevational view showing the closure partially opened and the position of the user's fingers during opening.

When it is desired to dislodge the clip from the closed position of FIG. 4, this can be done, again, with one hand of the user. Here, it is merely necessary to insert the finger, as can be seen in FIG. 5, between the ends 14 and 15 and place the thumb on the projection 32 and the finger on end 15. At this time, bringing the thumb and finger together pinches and flexes end 15 about point X so as to pull lip 31*c* away from locking member 20 and disengage it therefrom, as can be seen in FIG. 4A, thereby permitting the leg 11 to spring up and return to a position somewhere between that of FIG. 4 and FIG. 1 thus permitting access to the interior of the bag B. The natural resiliency of tee material and the force exerted by the bag between legs 11 and 12 will assist in this operation.

While a full and complete description of the invention has been set forth in accordance with the dictates of the Patent Statutes, it should be understood that modifications can be resorted to without departing from the spirit hereof or the scope of the appended claims.

What is claimed is:

1. A one-piece closure formed of resilient, flexible material, comprising:

a) a first elongate leg having first and second ends;

b) a second elongate leg having first and second ends and a main body portion;

c) a hinge section integral with and interconnecting said first ends of said first and second legs;

d) a male locking member extending from one surface of said first leg adjacent its second end;

e) said second elongate leg having its second end terminating in a finger-engaging portion joined to said main body portion by a reduced thickness section;

f) said second elongate leg having a socket disposed adjacent said finger-engaging portion and opening into one surface of said leg;

g) a pressure member disposed adjacent said finger-engaging portion at the opposite end of said reduced thickness section from said finger-engaging portion and on an opposed surface of said leg opposite said socket;

h) said main body portion of said second leg having a substantially flat planar surface into which said socket opens; and i) said pressure member comprises an integral, substantially flat pad lying in a plane substantially parallel to the plane of said planar surface of said second leg.

* * * * *

UNITED STATES PATENT AND TRADEMARK OFFICE

CERTIFICATE OF CORRECTION

PATENT NO. : 5,123,146

DATED : June 23, 1992

INVENTOR(S) : Earle L. Olson

It is certified that error appears in the above-identified patent and that said Letters Patent is hereby corrected as shown below:

Col. 4, line 25, before the word "pressure, " (2nd occurrence) insert the word --through--.

Column 4, line 56, delete the word "tee" and insert therefor --the--.

Signed and Sealed this

Twenty-fourth Day of August, 1993

Bruce Lehman

*Attest:*

BRUCE LEHMAN

*Attesting Officer*

*Commissioner of Patents and Trademarks*